United States Patent [19]

Morin

[11] Patent Number: 4,509,490

[45] **Date of Patent: * Apr. 9, 1985**

[54] BUILT-IN HYDRAULIC AUTOMATIC DEVICE FOR ADVANCING THE INJECTION OF A DIESEL ENGINE

[75] Inventor: Rene' Morin, Pelussin, France

[73] Assignee: Renault Vehicules Industriels, France

[ * ] Notice: The portion of the term of this patent subsequent to Aug. 30, 2000 has been disclaimed.

[21] Appl. No.: 399,660

[22] Filed: Jul. 19, 1982

Related U.S. Application Data

[63] Continuation of Ser. No. 107,882, Dec. 28, 1979, Pat. No. 4,401,088.

[30] Foreign Application Priority Data

Dec. 29, 1978 [FR] France ..... 78 37109

[51] Int. Cl.[3] ..... F02M 59/20; F02D 5/00

[52] U.S. Cl. ..... 123/502; 123/501; 464/5; 464/2

[58] Field of Search ..... 123/502, 501, 500; 464/5, 2

[56] References Cited

U.S. PATENT DOCUMENTS

| | | | |
|---|---|---|---|
| 3,650,125 | 3/1972 | Phillips | 64/25 |
| 3,774,411 | 11/1973 | Phillips | 64/25 |
| 4,401,088 | 8/1983 | Morin | 123/502 |

FOREIGN PATENT DOCUMENTS

| | | | |
|---|---|---|---|
| 491336 | 3/1954 | Italy | 64/25 |

*Primary Examiner*—Charles J. Myhre
*Assistant Examiner*—Carl Stuart Miller
*Attorney, Agent, or Firm*—Remy J. VanOphem

[57] ABSTRACT

A hydraulic automatic device for the injection advance of a diesel engine. The device includes a hub fixed to the pump camshaft and a casing fixed to the drive pinion of the pump. Two rollers in the casing bear on the ramps of the pistons of which the position is a function of the speed of rotation, owing to two inertia blocks, the thrust of the pistons and the control of the slide valve of a hydraulic distributor. Thus at each speed of rotation, there corresponds a certain angular displacement of the components and a certain advance of the injections.

4 Claims, 12 Drawing Figures

BUILT-IN HYDRAULIC AUTOMATIC DEVICE FOR ADVANCING THE INJECTION OF A DIESEL ENGINE

This is a continuation of application Ser. No. 107,882, filed Dec. 28, 1979, now U.S. Pat. No. 4,401,088.

BACKGROUND OF THE INVENTION

1. Field of the Invention

The present invention concerns a built-in automatic device for the hydraulic advance of a diesel engine injection pump.

2. Description of the Prior Art

On a diesel engine, it is known that high drive forces must be applied to the crankshaft of the fuel injection pump. These forces are significantly the greater when large modern diesel engines are fitted to industrial vehicles. However, it is essential to introduce a variable angular displacement into the drive transmission of the injection pump shaft, this variation having to take into account the momentary operating conditions of the engine in order to carry out the control of the injection advance.

Mechanical automatic devices for controlling the injection advance are known. These devices do not stand up well to high drive forces and, therefore, becoming less common are in the case of large diesel engines.

Several types of hydraulic automatic devices for controlling the injection advance are known, and these do not have the disadvantage of the mechanical devices. The hydraulic devices are generally found in the form of a coupling sleeve, and are in all cases bulky and complicated. These devices are all the more costly in that they complicate the fitting of the injection pump.

SUMMARY OF THE INVENTION

The invention aims at achieving a hydraulic automatic device for the injection advance which allows injection pumps known as "flanged" to be fitted, that is to say, injection pumps which fit directly to the engine by means of a mounting flange, the pump shaft drive being made directly, through, for example, a conical sleeve, and without the intervention of a coupling sleeve.

The invention aims at achieving a device of the aforementioned type which may be incorporated in a drive system consisting, for example, of a gear in the timing case of the diesel engine, this gear engaging with another gear mounted on the camshaft or on the crankshaft of the diesel engine.

The invention, therefore, has the aim of achieving a device of the aforementioned type which may be built into the diesel engine and housed inside the timing case of the engine.

A hydraulic automatic device for injection advance according to the invention, mainly for the injection pump of a diesel engine, consists of a revolving assembly co-axial with the camshaft of the injection pump and is characterized in that it includes:

a hub fixed to the injection pump camshaft;

a casing which is fixed to the drive pinion of the injection pump, which surrounds the hub, and which carries internally at least one roller parallel to the axis of the casing but disposed away from this axis;

in connection with each roller of the casing, a piston of which the axis is at right angles to the axis of the device, each piston being fitted to slide in a blind bore in the hub and having a lateral bearing ramp which acts with the corresponding roller of the casing; and a hydraulic circuit including within the hub at least one distributor of which the slide valve is operated by an eccentric inertia block which is able to move mainly under the action of centrifugal force, the distributor regulating the pressure in the chambers defined behind the pistons.

According to an additional characteristic of the invention, the device includes at least one spring which acts between the hub and the casing to hold each roller of the casing against the ramp of the corresponding piston.

According to an additional characteristic of the invention, the ramp of each piston is located near the front of the piston and slopes towards the axis of the piston, towards its front. This ramp is in addition, sufficiently inclined in relation to a transverse plane of the piston for the transmission of movement between the piston and the roller to be irreversible, that is to say, so that the piston cannot slide under the action of the thrust of the roller, no matter how strong it may be.

According to an additional characteristic of the invention, the inertia block which operates the slide valve is subject to the action of one of the pistons in the hub by means of a coil spring which is co-axial with this piston and which is compressed between this piston and the inertia block. The axis of the piston and the axis of the slide valve are parallel and lies on opposite sides of the pivot in the hub on which the inertia block is fitted so as to swing, the pivot itself being parallel to the axis of the device.

According to an additional characteristic of the invention, the main axis of the inertia block is substantially perpendicular to the axis of the piston which acts on the inertia block.

According to an additional characteristic of the invention the front face of the piston acting on the inertia block is tilted towards this inertia block, and the hydraulic distributor is arranged so as to cause the pressure in the chamber defined behind the piston to increase when the inertia block moves away from the distributor, the pivot on which the inertia block swings extending between the axis of the piston and the center of gravity of the inertia block.

According to an additional characteristic of the invention, the rear chamber of each piston is permanently connected to a feed of fluid under pressure, as well as to a fluid escape orifice which the slide valve can block progressively when the inertia block moves away from the distributor.

According to an additional characteristic of the invention, the feed of fluid under pressure includes a revolving seal fitted to one end of the hub.

According to an additional characteristic of the invention, the device includes two diametrically opposite inertia blocks of which only one is connected with the distributor slide valve.

BRIEF DESCRIPTION OF THE DRAWINGS

The attached drawings given by way of non-limiting example, will allow the characteristics of the invention to be better understood.

DESCRIPTION OF THE PREFERRED EMBODIMENT

Figure 2:
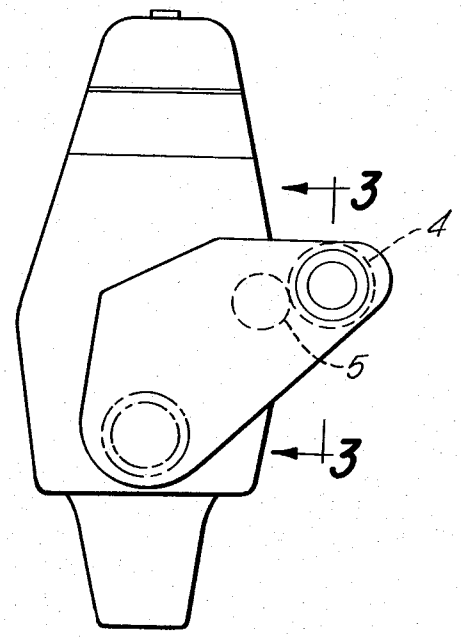
FIG. 2 is a front view of the same engine.
Figure 1:
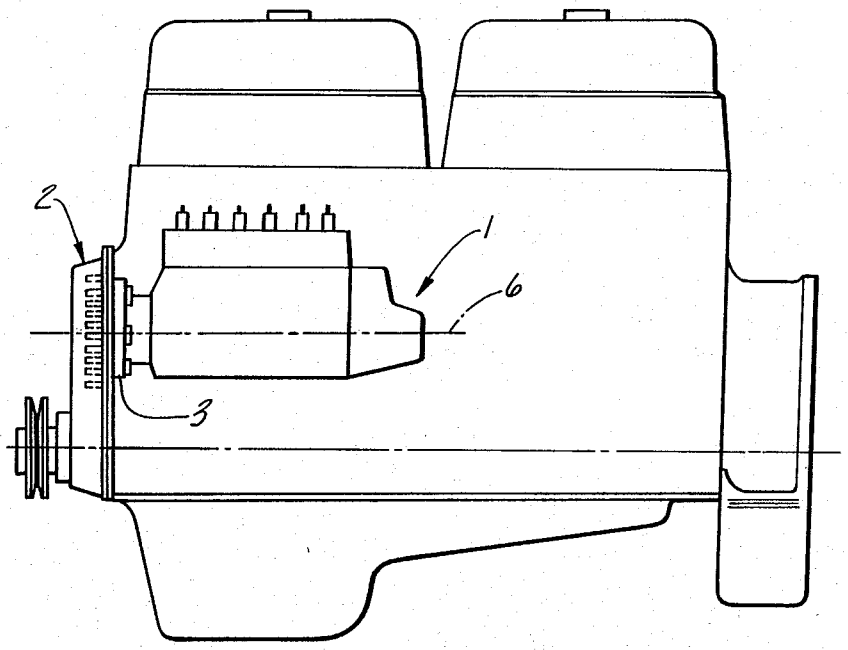
FIG. 1 is a side view of a diesel engine fitted with a hydraulic automatic device for advancing the injection according to the invention.

There is shown in FIG. 1, in a simplified way, a diesel engine fitted with a device according to the invention. A six cylinder engine fitted with an injection pump 1 and a timing case 2 is shown. The injection pump 1 is known as "flanged", which means that it carries a circular fixing flange 3 by means of which it is attached to the engine. This attachment is carried out directly, without the intervention of a coupling sleeve. The drive pinion 4 of the cam shaft 40 of the injection pump 1 is located inside the timing case 2. The drive pinion 4 engages a pinion 5 driven by the crankshaft of the engine (FIG. 2).

The device according to the invention is constituted by a compact revolving assembly of which the axis 6 is coaxial with the axis of the camshaft of the injection pump 1. This device includes mainly, on the one hand, a hub 7 which is fixed to the camshaft of the injection pump 1, and on the other hand a casing 8 which is attached to the drive pinion 4 (see FIGS. 3 to 8).

The casing 8, which encloses the hub 7, carries internally two rollers 9 and 10 which are diametrically opposite, parallel to the axis 6, and situated a predetermined distance from the axis 6.

The rollers 9 and 10 are associated with, respectively, pistons 11 and 12. The axes of the pistons 11 and 12 are at right angles to the axis 6. The pistons 11 and 12 have lateral bearing ramps 13 and 14, respectively, which work in conjunction with rollers 9 and 10, respectively. The rollers 9 and 10 are mounted to slide in a blind bore in the hub 7. The lateral bearing ramps 13 and 14 are sufficiently inclined in relation to a transverse plane through the corresponding pistons for the transmission of movement between the pistons and the rollers to be irreversible, that is to say, so that the pistons cannot slide under the action of the thrust of the rollers no matter how strong the thrust may be.

Pressure chambers 15 and 16 are formed behind the pistons 11 and 12 and are in communication with an annular passage 17 into which is fed a fluid under pressure. This feed includes a revolving seal 18 fitted on one end of the hub 7, a calibrated radial hole 19 drilled into the hub 7, and a pipe 20 for delivering fluid under pressure (not shown), as well as a channel 21 which extends longitudinally into the hub 7 between the calibrated radial hole 19 and the annular passage 17.

Figure 6:
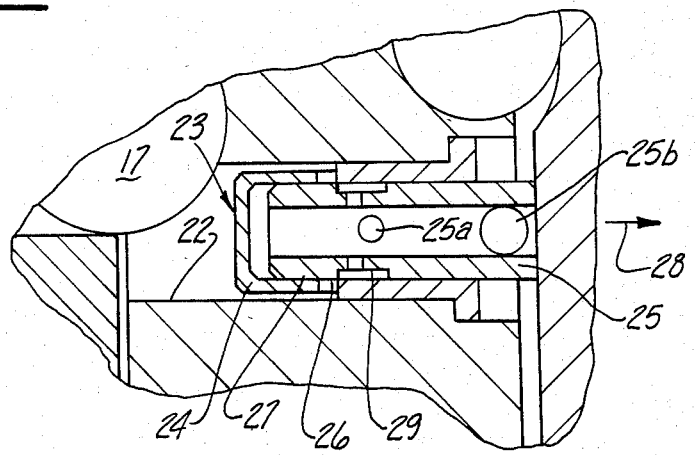
FIG. 6 is an enlarged portion of FIG. 5 showing the hydraulic distributor of the device.

The annular passage 17 similarly communicates with a bore 22 which is parallel to the pistons 11 and 12 in the hub 7, and encloses a distributor 23 including a fixed cap 24 and a slide valve 25 (FIG. 6). The cap 24 has radial openings 26 which may either be blocked by a cylindrical rear extension 27 of the slide valve 25, when this slide valve moves forward in the direction of the arrow 28, or open into an annular throat 29 in the slide valve when the latter moves rearwardly. Since the slide valve 25 is tubular, with radial openings 25*a* and 25*b* which open on the one hand into the annular throat 29 and on the other to the outside at the front of the fixed cap 24, and annular throat 29 is always connected to the outlet. The hydraulic fluid which escapes simply falls back into the timing case 2.

Finally the device includes two inertia blocks 30 and 31 which are diametrically opposite each other and have main axes which are substantially perpendicular to the axes of the pistons 11 and 12. The inertia block 30, which is under the action of the piston 11, is mounted to swing about a pivot 32 in the hub 7. The pivot 32 is parallel to the axis 6 of the device. A coil spring 33, co-axial with the piston 11, is compressed between one end of the inertia block 30 and the bottom of a blind bore 34 hollowed in the piston 11. The other end of the inertia block 30 is able to push the front face of the slide valve 25 backwards. The axis of the piston 11 and the axis of the slide valve 25 lie on opposite sides of the pivot 32. The center of gravity of the inertia block 30 on the other hand lies between the pivot 32 and the geometrical axis of the slide valve 25. The inertia block 31, which is subject in a similar way to the action of the piston 12, is mounted in an identical manner to the inertia block 30. The inertia block 31 is not in contact with any slide valve, unlike the inertia block 30, but the unbalance caused by this asymmetry is entirely negligible. Taking account of the very small mass of the slide valve 25 in relation to the mass of the inertia block 30, the centrifugal force acting on this slide valve is insignificant, and need not be taken into account in the operation of the device.

Figure 4:
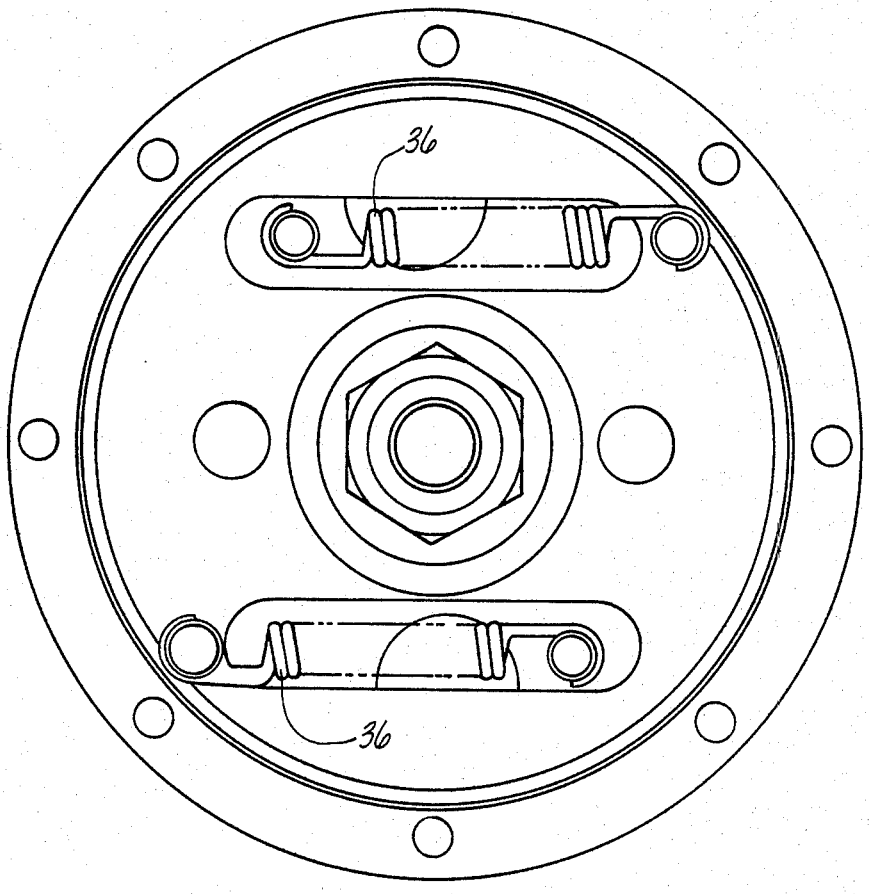
FIG. 4 is a front view of the device according to the invention.
Figure 5:
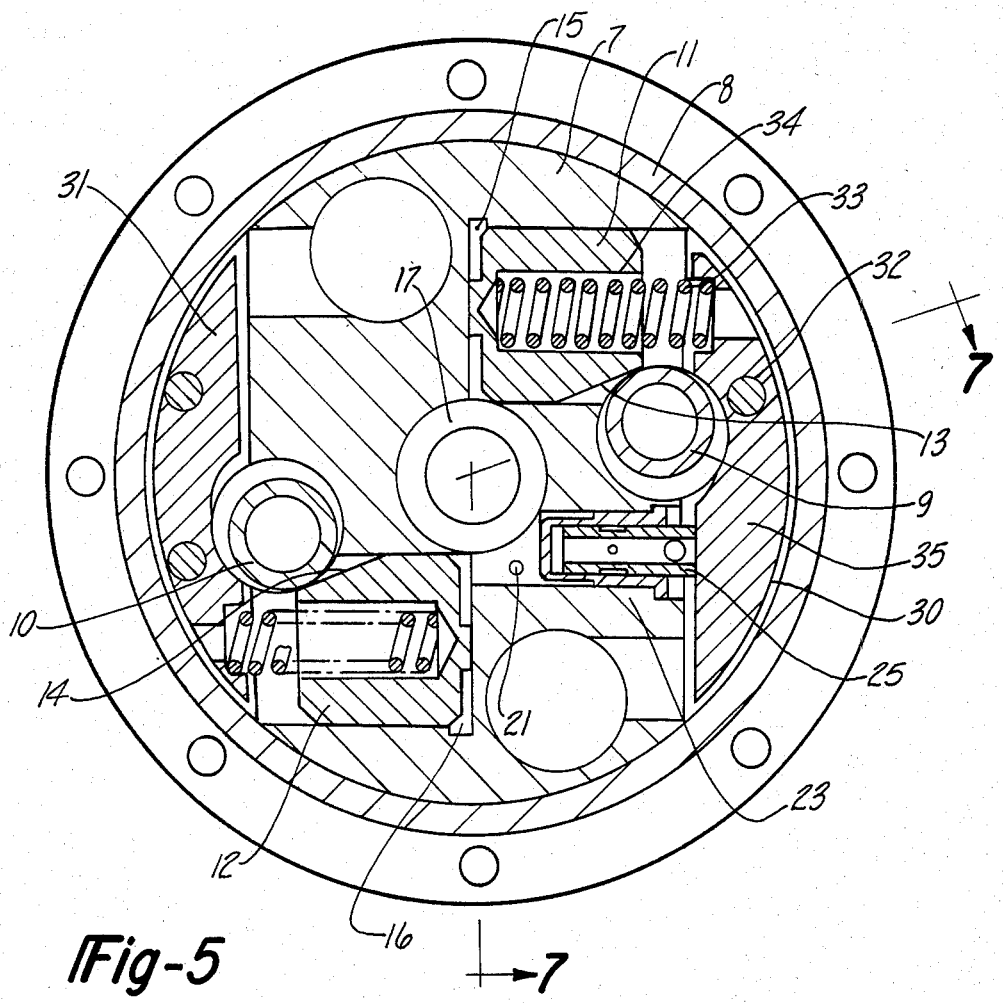
FIG. 5 is a section along V—V of FIG. 7.

Two return springs 36 are permanently stretched between the hub 7 and the casing 8, on the front of the device as shown in FIG. 4, to hold the rollers 9 and so as to be constantly bearing against lateral bearing ramps 13 and 14.

Figure 9:
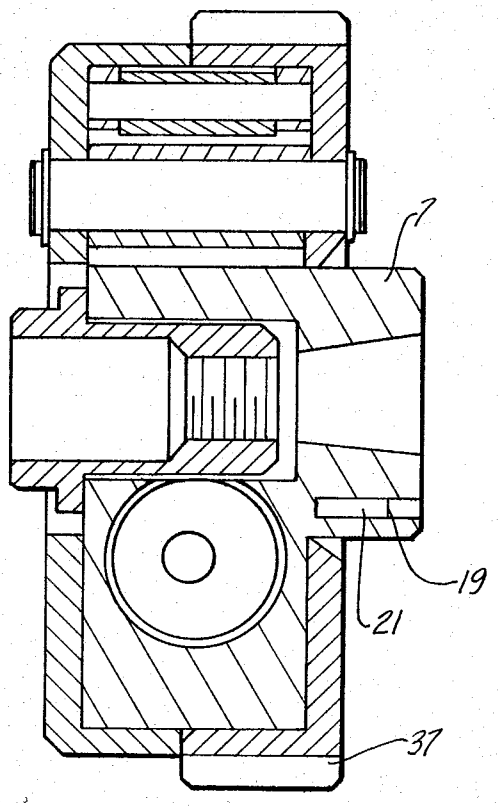
FIGS. 9 and 10 are views corresponding respectively to FIGS. 7 and 8, showing a manufacturing variant of the device according to the invention.
Figure 8:
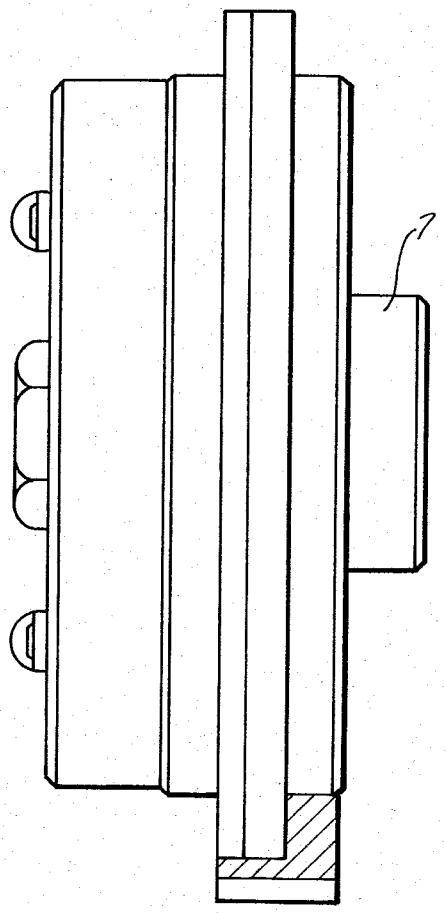
FIG. 8 is a side view of the device according to the invention.
Figure 7:
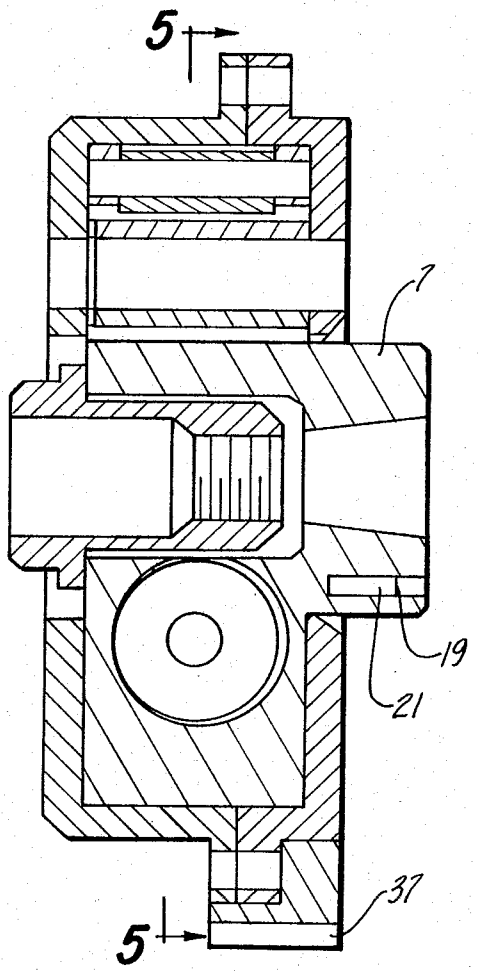
FIG. 7 is a section along VII—VII of FIG. 5
Figure 10:
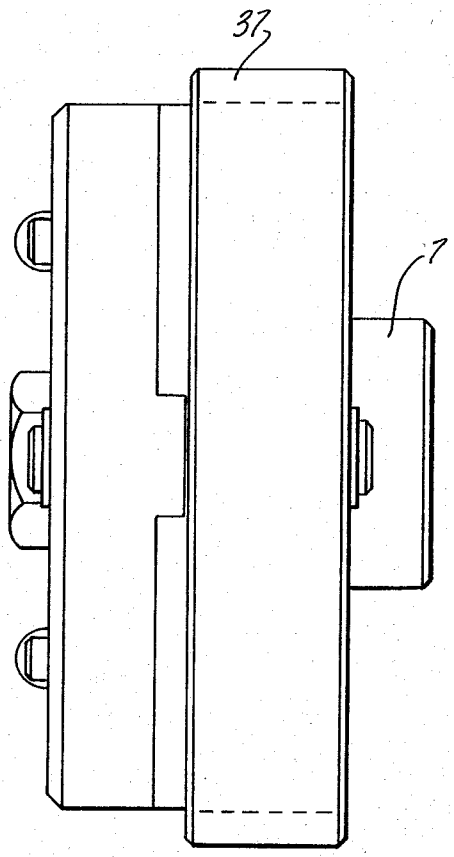

It will be seen that the device is compact and is built into the drive pinion 4. This pinion may be fitted with a toothed ring or teeth 37 applied to the periphery of the casing 8 (see FIGS. 7 and 8), but the teeth 37 may also be cut directly on the outside of the casing 8 (FIGS. 9 and 10).

Figure 3:
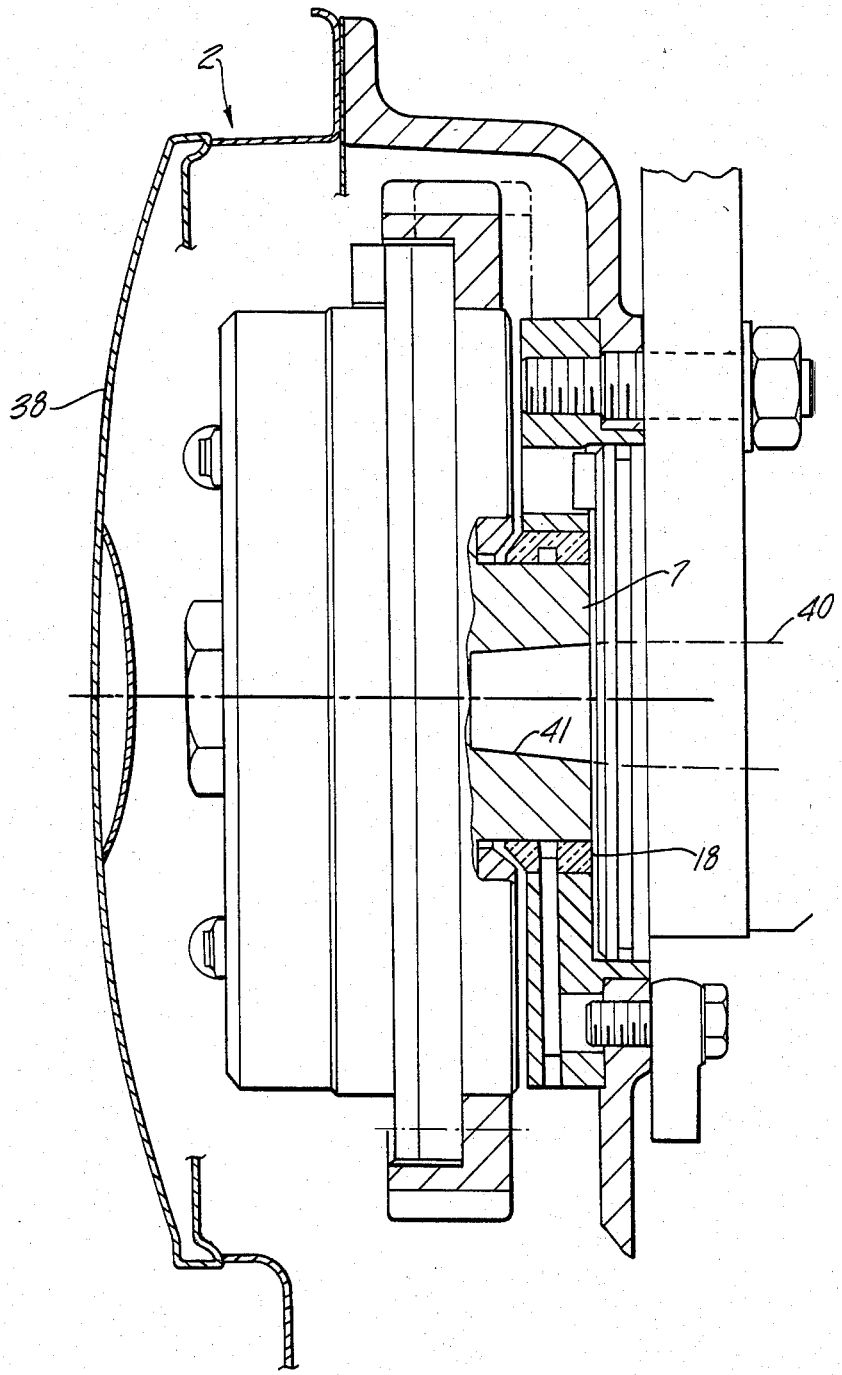
FIG. 3 is a section along III—III of FIG. 2 in which the engine is shown only close to the device according to the invention.

FIG. 3 shows the simplicity of assembling the device and its maintenance; by removing the inspection cover 38 in the timing case 2 there is immediate access to the entire device and to the locking bolt 39 by means of which the camshaft 40 of the pump 1 is locked onto the hub 7. The camshaft 40 is fixed in this hub by means of a conical sleeve 41.

The operation is as follows:

When the system is at rest, that is to say, when centrifugal forces have not acted on the inertia blocks 30 and 31, the latter are subject only to the action of the coil springs 33. Thus, taking account of the position of the extreme swing in which the inertia block 30 is held, the slide valve 25 is pressed inwardly and the distributor connects the pressure chambers 15 and 16 to the outlet. The pistons 11 and 12 remain at rest.

Figure 11:
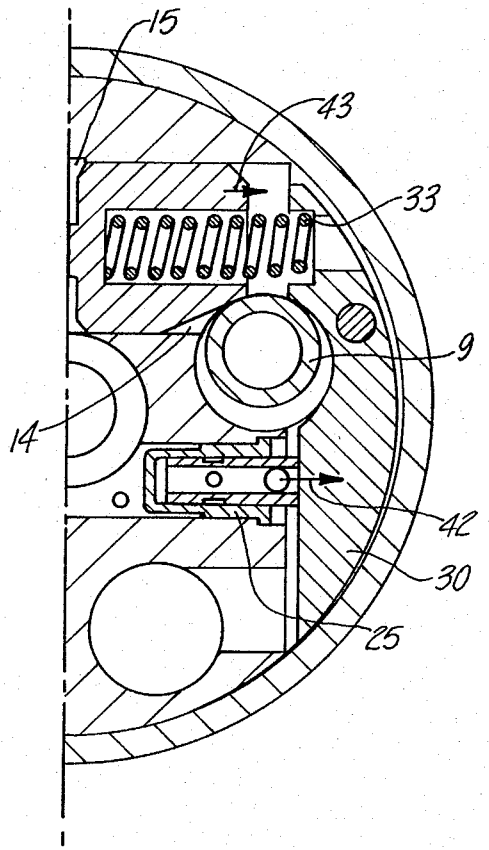

After a certain speed of rotation of the pinion 4, is reached the inertia blocks 30 and 31 move outwardly under the effect of centrifugal force (FIG. 11), and the freed slide valve 25 moves outwardly (arrow 42), which causes the pressure in the pressure chambers 15 and 16 to rise. Immediately the two pistons 11 and 12 move forward (arrow 43), which has the consequences of:

creating a certain angular displacement between the hub 7 and the casing 8, since the rollers 9 and 10 "climb" the lateral bearing ramps 13 and 14 of the pistons; and increasing the compression in the coil springs 33.

Figure 12:
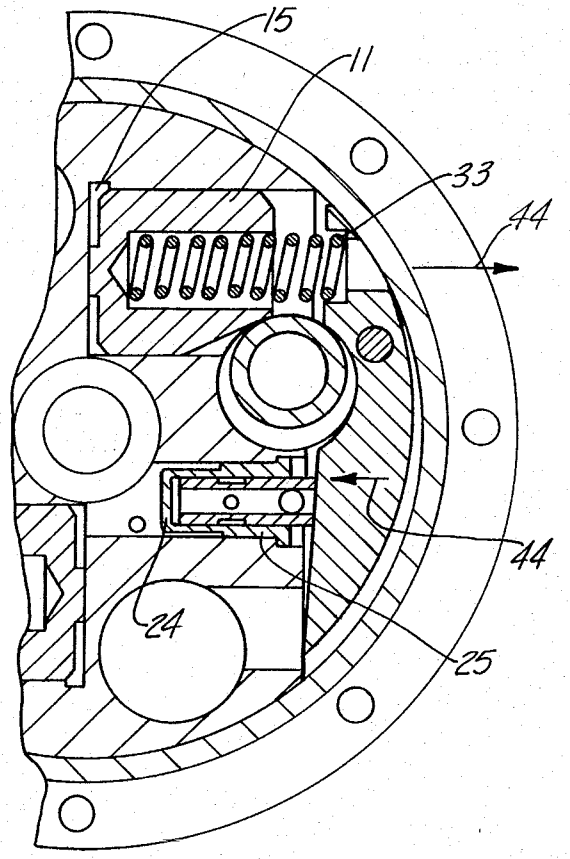
FIGS. 11 and 12 are partial diagrammatic views corresponding to FIG. 5 and showing the operation of the device.

The coil springs 33 oppose the centrifugal force by bringing the center of gravity of the inertia blocks back inwardly (FIG. 12, arrows 44). The inertia blocks 30 and 31 then return to their starting positions, the inertia block 30 pressing the slide valve 25 into the fixed cap 24 and making the fluid pressure in the pressure chambers 15 and 16 fall once more.

In fact, a balance is rapidly reached between the oil pressure in the pressure chambers 15 and 16, the tension of the springs 33, and centrifugal force. The establishment of this balance causes immobilization of the pistons 11 and 12 at an intermediate point in their sliding movement, that is to say, at a certain angular displacement between the hub 7 and the casing 8. Thus at each speed of rotation, there corresponds a certain angular displacement of the components and a certain advance of the injection.

It will be seen that it is possible to establish a relationship or law giving the value of the angular displacement in relation to the travel of the pistons by varying the profile of the lateral bearing ramps 13 and 14. This allows the size of the error of position of the pistons in relation to their travel to be reduced.

It is possible to modify the law for injection advance by changing the stiffness of the coil springs 33. By changing the initial calibration of the coil springs 33, the beginning of the development of injection advance is modified.

The lateral bearing ramps 13 and 14 may also be replaced by ramps which allow a law of advance to be obtained which is not directly proportional to the speed of rotation of the camshaft 40.

The device according to the invention has the following main advantages:

The hydraulic and mechanical arrangements allow the pistons to be moved by a pressure of oil which is in relation to the speed of rotation such that the operation is simple and free from oscillation phenomena or risk of breakdown. In particular, no use is made of small springs which are very fragile and difficult to calibrate.

The angular indexing obtained is both precise and stable in relation to the speed of rotation.

Due to the fact that the operation is, irreversible the force component acting on the pistons and arising from the high and irregular drive couple of the injection pump is not able to move the pistons 11 and 12. This allows great stability of operation to be obtained. In particular, it is useless to close the hydraulic circuit after each movement of the pistons 11 and 12, the latter having no need to remain supported by a hydraulic cushion since the control is irreversible.

The operation is very progressive and free from oscillations such as those due to repeated opening and closing of a slide valve.

The fluid under pressure used is advantageously, but not necessarily, the lubrication oil of the engine. From the point of view of the dependability of operation, the oil-tightness is not of paramount importance, from the fact that the device is located inside the timing case of the engine. All leaks are automatically collected.

The injection pump is fixed in cantilever, by means of the fixing flange. This particularly simple and practical mounting reduces the bulk of the assembly, and avoids the use of any other fixing device of the pump to the engine block.

What I claim is:

1. An automatic device for advancing the fuel injection pump of a diesel engine in response to engine speed, said fuel injection pump having a camshaft with a first central axis, said automatic device comprising:

a hub member having a second central axis substantially aligned with said first central axis of said camshaft of said fuel injection pump;

at least one cavity in said hub member, said at least one cavity having a third central axis spaced a predetermined distance from said second central axis of said hub member;

passage means in said hub member, said passage means having an inlet and an outlet;

means for connecting said passage means to said at least one cavity such that said inlet and said outlet of said passage means communicate with said at least one cavity;

a casing member rotatably mounted to said hub member, said casing member further surrounding a portion of said hub member;

at least one roller member fixed to said casing member for rotative movement therewith, said at least one roller member further being partially disposed in said at least one cavity of said hub member for communication therewith;

moving means, for rotatably moving said casing member relative to said hub member, said moving means being mounted in said at least one cavity in spaced relationship to said at least one roller member and contacting said at least one roller member such that linear movement of said moving means rotates said at least one roller member about said second central axis of said hub member; said moving means for rotatably moving said casing further comprising:

(a) at least one piston member movably disposed in said at least one cavity, said at least one piston member having one end engageable with said at least one roller member and an other end opposite said one end;

(b) displacement means for displacing said piston member against said at least one roller member such as to displace said at least one roller member in order to advance said fuel injection pump of said diesel engine, said displacement means being responsive to said engine speed;

valve distribution means mounted in said passage means for terminating communication between said at least one cavity and said outlet of said passage means; said valve distribution means further comprising:

(a) a second cavity located in said hub member, said second cavity having a fourth central axis parallel to said third central axis;

(b) cap means mounted in said second cavity, said cap means having a central aperture and a plurality of radial holes, each of said plurality of radial holes providing flow communication between said central aperture and said second cavity; and (c) slide means movably disposed in said central aperture, said slide means having passageway means selectively communicating said plurality of radial holes with said outlet to regulate the pressure in said second cavity;

centrifugal displacement means, for centrifugally displacing said valve distribution means, said centrifugal displacement means being mounted to said hub member and having one end portion contiguous to said valve distribution means and an other opposite end portion adapted to engage said moving means; and rotative driving means, for rotatively driving said casing member, said rotative driving means being mounted to the outer periphery of said casing member.

2. An automatic device for advancing the fuel injection pump of a diesel engine in response to engine speed, said fuel injection pump having a camshaft with a first central axis, said automatic device comprising:

a hub member having a second central axis substantially aligned with said first central axis of said camshaft of said fuel injection pump;

at least one cavity in said hub member, said at least one cavity having a third central axis spaced a predetermined distance from said second central axis of said hub member;

passage means in said hub member, said passage means having an inlet and an outlet;

means for connecting said passage means to said at least one cavity such that said inlet and said outlet of said passage means communicate with said at least one cavity;

a casing member rotatably mounted to said hub member, said casing member further surrounding a portion of said hub member;

at least one roller member fixed to said casing member for rotative movement therewith, said at least one roller member further being partially disposed in said at least one cavity of said hub member for communication therewith;

moving means, for rotatably moving said casing member relative to said hub member, said moving means being mounted in said at least one cavity in spaced relationship to said at least one roller member and contacting said at least one roller member such that linear movement of said moving means rotates said at least one roller member about said second central axis of said hub member; wherein said moving means further comprises:

(a) at least one piston member having one end mounted in said at least one cavity and an opposite end disposed remote from said one end, said one end of said at least one piston member and a bottom portion of said at least one cavity defining at least one pressure chamber, said at least one piston member having a biasing ramp on said opposite end, said biasing ramp being contiguous to said at least one roller member for cooperative engagement therewith;

(b) a second cavity located in said hub member, said second cavity having a fourth central axis parallel to said third central axis of said at least one cavity, said second cavity being in communication with said passage means;

(c) fluid supply means for supplying pressurized fluid to said at least one pressure chamber in response to said engine speed, said fluid supply means being mounted in said second cavity such that above a predetermined engine speed, said pressurized fluid in said at least one pressure chamber forces said at least one piston member in said at least one cavity to move towards said at least one roller member such that said biasing ramp of said at least one piston member biases said at least one roller member angularly in order to advance said fuel injection pump of said diesel engine; and (d) at least one biasing member connecting said hub member to said casing member, said at least one biasing member biasing said biasing ramp of said at least one piston member into contiguous engagement with said at least one roller member;

valve distribution means mounted in said passage means for terminating communication between said at least one cavity and said outlet of said passage means;

centrifugal displacement means, for centrifugally displacing said valve distribution means, said centrifugal displacement means being mounted to said hub member and having one end portion contiguous to said valve distribution means and another opposite end portion adapted to engage said moving means; and rotative driving means, for rotatively driving said casing member, said rotative driving means being mounted to the outer periphery of said casing member.

3. An automatic device for advancing the fuel injection pump of a diesel engine in response to engine speed, said fuel injection pump having a camshaft with a first central axis, said automatic device comprising:

a hub member having a second central axis substantially aligned with said first central axis of said camshaft of said fuel injection pump;

at least one cavity in said hub member, said at least one cavity having a third central axis spaced a predetermined distance from said second central axis of said hub member;

passage means in said hub member, said passage means having an inlet and an outlet;

means for connecting said passage means to said at least one cavity such that said inlet and said outlet of said passage means communicate with said at least one cavity;

a casing member rotatably mounted to said hub member, said casing member further surrounding a portion of said hub member;

at least one roller member fixed to said casing member for rotative movement therewith, said at least one roller member further being partially disposed in said at least one cavity of said hub member for communication therewith;

moving means, for rotatably moving said casing member relative to said hub member, said moving means being mounted in said at least one cavity in spaced relationship to said at least one roller member and contacting said at least one roller member such that linear movement of said moving means rotates said at least one roller member about said second central axis of said hub member;

valve distribution means mounted in said passage means for terminating communication between said at least one cavity and said outlet of said passage means; wherein said valve distribution means further comprises:

(a) a second cavity located in said hub member, said second cavity having a fourth central axis parallel to said third central axis of said at least one cavity, said second cavity further communicating with said passage means; and (b) a distributor member mounted in said hub member, said distributor member further comprising:

(i) a cap member mounted in said second cavity, said cap member having an open end, a closed end opposite said open end; a central aperture extending from said closed end to said open end, a plurality of radial holes betweeen said closed end and said open end, each of said plurality of radial holes providing flow communication between said central aperture and said second cavity; and (ii) a tubular slide member mounted in said central aperture of said cap member, said tubular slide member having an inlet, an outlet opposite said inlet, a central passage extending from said inlet to said outlet, and a plurality of radial openings adjacent to said inlet for flow communication with said plurality of radial openings in said cap member, said tubular slide member further being slidable in said central aperture of said cap member such that in a first predetermined position, said tubular slide member prevents fluid flow communication between said passage means and said outlet of said tubular slide member, thereby increasing the fluid pressure in said at least one cavity and in a second predetermined position, said tubular slide member permitting fluid flow communication between said passage means and said outlet of said tubular slide member through said plurality of radial openings of said tubular slide member and said plurality of radial openings of said cap member, thereby reducing the fluid pressure in said at least one cavity;

centrifugal displacement means, for centrifugally displacing said valve distribution means, said centrifugal displacement means being mounted to said hub member and having one end portion contiguous to said valve distribution means and another opposite end portion adapted to engage said moving means; and rotative driving means, for rotatively driving said casing member, said rotative driving means being mounted to the outer periphery of said casing member.

4. The device as claimed in Claim 3 wherein said centrifugal displacement means further comprises:

at least one pivot pin member mounted to said hub member, said at least one pivot pin member being mounted in a spaced relationship to said at least one roller member;

at least one inertia block member pivotally mounted to said at least one pivot pin member;

means for connecting said passage means to said at least one cavity for flow communication therebetween;

bias means for biasing said moving means; said bias means being interposed said at least one inertia block member and said moving means; and fluid supply means for supplying fluid under pressure to said passage means.

* * * * *

UNITED STATES PATENT AND TRADEMARK OFFICE

CERTIFICATE OF CORRECTION

PATENT NO. : 4,509,490

DATED : April 9, 1985

INVENTOR(S) : Rene Morin

It is certified that error appears in the above-identified patent and that said Letters Patent is hereby corrected as shown below:

Column 1, line 17, delete "the".

Column 1, line 27, after "therefore," insert ---- are ----.

Column 1, line 28, delete "are".

Column 3, line 68, delete "The cap" and insert ---- The fixed cap ----.

Column 4, line 9, delete "and annular" and insert ---- the annular ----.

Column 4, line 40, delete "rollers 9 and" insert ---- rollers 9 and 10 ----.

UNITED STATES PATENT AND TRADEMARK OFFICE

CERTIFICATE OF CORRECTION

PATENT NO. : 4,509,490

DATED : April 9, 1985

INVENTOR(S) : Rene Morin

Sheet 2 of 2

It is certified that error appears in the above-identified patent and that said Letters Patent is hereby corrected as shown below:

Column 4, line 41, delete "against lateral" and insert ---- against the lateral ----.

Column 4, line 65, delete the comma ",".

Column 4, line 66, after "reached" insert a comma ---- , ----.

Signed and Sealed this

*Twenty-third* Day of *July 1985*

[SEAL]

*Attest:*

DONALD J. QUIGG

*Attesting Officer* *Acting Commissioner of Patents and Trademarks*